US005547417A

United States Patent [19]

Breivogel et al.

[11] Patent Number: 5,547,417

[45] Date of Patent: Aug. 20, 1996

[54] METHOD AND APPARATUS FOR CONDITIONING A SEMICONDUCTOR POLISHING PAD

[75] Inventors: Joseph R. Breivogel, Aloha; Matthew J. Price; Christopher E. Barns, both of Portland, all of Oreg.

[73] Assignee: Intel Corporation, Santa Clara, Calif.

[21] Appl. No.: 210,957

[22] Filed: Mar. 21, 1994

[51] Int. Cl.[6] ..... B24B 53/00

[52] U.S. Cl. ..... 451/58; 451/443

[58] Field of Search ..... 451/56, 285, 286, 451/287, 289, 443, 444

[56] References Cited

U.S. PATENT DOCUMENTS

| | | | |
|---|---|---|---|
| 2,826,009 | 3/1958 | Shurson et al. . | |
| 4,481,738 | 11/1984 | Tabuchi | 451/289 |
| 4,839,993 | 6/1989 | Masuko et al. | 451/283 |
| 4,984,390 | 1/1991 | Kobayashi | 451/443 |
| 5,216,843 | 6/1993 | Breivogel et al. . | |
| 5,384,986 | 1/1995 | Hirose et al. | 451/444 |

*Primary Examiner*—Maurina T. Rachuba
*Attorney, Agent, or Firm*—Blakely, Sokoloff, Taylor & Zafman

[57] ABSTRACT

A method of polishing a thin film formed on a semiconductor substrate. In a method of the present invention a polishing pad is rotated. A substrate is pressed against the rotating polishing pad so that the thin film to be polished is placed in direct contact with the polishing pad. During polishing, the polishing pad is continually conditioned by forming a plurality of grooves into the polishing pad. The grooves are formed by a conditioning block having a substantially planar bottom surface with a plurality of groove generating points extending from the substantially planar surface of the conditioning block. The grooves are generated by sweeping and rotating the conditioning block between an outer radius and an inner radius of the polishing pad.

19 Claims, 5 Drawing Sheets

METHOD AND APPARATUS FOR CONDITIONING A SEMICONDUCTOR POLISHING PAD

BACKGROUND OF THE INVENTION

1. Field of the Invention

The present invention relates to the field of semiconductor processing; and more specifically to the field of conditioning methods and apparatuses for polishing pads used in the planarization of thin films formed on a semiconductor substrate.

2. Discussion of Related Art

Integrated circuits (ICs) manufactured today generally rely upon an elaborate system of metallization interconnects to couple various devices which have been fabricated in the semiconductor substrate. The technology for forming these metallized interconnects is extremely sophisticated and well understood by practitioners in the art. Commonly, aluminum or some other metal is deposited and then patterned to form interconnection paths along the surface of the silicon substrate. In most processes a dielectric or insulated layer is then deposited over the first metal (metal 1) layer; via openings are etched through the dielectric layer and the second metallization layer is deposited. The second metal layer covers the dielectric layer and fills the via openings thereby making an electrical contact down to the metal 1 layer. The purpose of this dielectric layer, of course, is to act as an insulator between metal 1 and metal 2 interconnections. Most often the intermetal dielectric layer comprises a chemical vapor deposition (CVD) of silicon dioxide which is normally formed to a thickness of approximately one micron. (Conventionally, the underlying metal 1 interconnections are also formed to a thickness of approximately one micron.) The silicon dioxide layer covers the metal 1 interconnections conformably such that the upper surface of the silicon dioxide layer is characterized by a series of non-planar steps which correspond in height and width to the underlying metal 1 layers.

These step height variations in the upper surface of the interlayer dielectric have several undesirable features. First, non-planar dielectric surfaces interfere with the optical resolution of subsequent photolithography processing steps. This make it extremely difficult to print high resolution lines. A second problem involves a step coverage of metal 2 (second metal) layer over the interlayer dielectric. If the step height is too large there is a serious danger that open circuits will be formed in metal 2 layer.

To combat these problems, various techniques have been developed in an attempt to planarize the upper surface of the interlayer dielectric (ILD). One approach, shown in FIGS. 1*a* and 1*b*, employs an abrasive polishing to remove the protruding steps along the upper surface of the dielectric. According to this method a silicon substrate or wafer 102 is forced faced down by quill 103 on a table 104 covered with flat pad 106 which has been coated with an abrasive material (slurry) 108. Both wafer 102 and table 104 are rotated relative to each other under pressure to remove the protruding portions. The abrasive polishing process continues in this manner until the upper surface of the dielectric layer is largely flattened.

Polishing pads 106 of the type used for wafer planarization suffer from a reduction in polishing rate and uniformity due to a loss in sufficient surface roughness. One method of countering the smoothing of polishing pad 106 and achieving and maintaining high and stable polishing rates is pad conditioning. Pad conditioning is the technique whereby the pad surface is put into a proper state for polishing work. This normally entails forming a plurality of microgrooves in the upper polishing pad surface prior to polishing. The microgrooves help to facilitate the polishing process by providing point contacts and by aiding in slurry delivery to the pad/substrate interface. These initially provided grooves, however, become worn or smooth over time necessitating the continual generation of grooves in polishing pad 106 during polishing.

In one conditioning method, shown in FIGS. 1*a* and 1*b* and described in U.S. Pat. No. 5,216,843 which is assigned to the present assignee, a multitude of fine microgrooves 110 are formed in the surface of polishing pad 106 with a diamond pointed 112 conditioning block 114. Microgrooves 110 are formed during the polishing process by pivoting diamond conditioning block 114 back and forth across the area 116 of pad 106 which contacts substrate 102. The sweep rate of diamond conditioning block 114 can be varied to condition some parts of the polishing pad 106 more than others (i.e., nonuniformly condition polishing pad 106). Nonuniform conditioning allows those areas of polishing pad 106 which become smoothed to be conditioned more so that the overall roughness of polish pad 106 is uniformly maintained. It is to be appreciated that the polishing rate in this polishing process is proportional to the roughness of the polishing pad (i.e., the amount of conditioning received by the polishing pad). Nonuniform conditioning can improve polish uniformity across the surface of a substrate by maintaining a consistant roughness across the polishing pad.

A problem with conditioning polishing pad 106 with the technique shown in FIG. 1*a* and 1*b*, is that although nonuniform conditioning can be achieved with this technique it has been found that its effectiveness is limited. Since conditioning block 114 is rigidly connected to conditioning arm 115, microgroove formation depends on the relative motion of polishing pad 106 and diamond conditioning block 114. In order to increase conditioning of one part of polishing pad 106, the other parts of polishing pad 106 must receive less conditioning. It is to be appreciated that polish rate is proportional to the amount of pad conditioning. In order to nonuniformly condition polishing pad 106 and still maintain a manufacturably acceptable polish rate, it would be necessary to increase the oscillation frequency of diamond conditioning block 114. There is, however, a practical limit (approximately two cycles per second) to oscillation frequency, due to mechanical inertia. Thus, because diamond conditioning block 114 is rigidly attached to conditioning arm 115, nonuniform conditioning of polishing pad 106 can not be obtained without decreasing the overall polish rate. A low polish rate decreases wafer throughput and increases fabrication costs.

Another method for conditioning a polishing pad uses a large diameter diamond particle covered disk (typically about six inches in diameter). In this method the large disk is pressed against the polishing pad and rotated while the polishing pad rotates. One problem with this technique for conditioning a polishing pad is that nonuniform polishing cannot be obtained. Another problem with this technique is the large diameter disk which is used. A large diameter disk has been found unsuitable due to a combination of insufficient surface flatness as well as its inability to track surface variations across the polishing track left in the polishing pad. Such a conditioner tends to gouge portions of the polishing pad while not sufficiently conditioning other portions. Additionally, the grit size and spacing are also difficult to control which has a direct effect on the process and its repeatability disk to disk. Still further, this type of conditioning apparatus easily loses diamond particles which become embedded in the polishing pad and later scratch wafers or substrates. Thus, conditioning with a large diameter rotating disk has been found unsuitable for ultra-large scale integrated circuit (ULSI) manufacturing processes.

Thus, what is required is an improved method and apparatus for conditioning a polishing pad used in semiconductor manufacturing wherein a polishing pad can be nonuniformly conditioned without decreasing the overall polish rate.

SUMMARY OF THE INVENTION

A method and apparatus for polishing a thin film formed on a semiconductor substrate is described. In the method of the present invention a polishing pad is rotated. A wafer is pressed against the rotating polishing pad so that the thin film to be polished is placed in direct contact with the polishing pad. During polishing, the polishing pad is continually conditioned by forming a plurality of grooves into the polishing pad. The grooves are formed by rotating a conditioning block at a rate of between 200–2000 rotations per minute while moving the rotating conditioning block between an outer radius and an inner radius of the polishing pad at a rate of between one to fifteen cycles per minute. In a preferred embodiment of the present invention the conditioning block is swept at a constant rate between the outer and inner radii of the polishing pad while the rotation rate is varied for different radii of the polishing pad. The conditioning block can be rotated fastest while at the middle radii so that the middle radii receives the most conditioning. Alternatively, the rotation rate of the conditioning block can be held constant while the sweep rate is varied for different radii of the polishing pad. A plurality of discrete point contacts, such as diamond tipped threaded shanks extending from the substantially planar bottom surface of the conditioning block, generate the grooves in the polishing pad as the conditioning block is rotated and swept across the polishing pad surface.

DETAILED DESCRIPTION OF THE PRESENT INVENTION

An improved method and apparatus for polishing a thin film formed on a semiconductor substrate is described. In the following description numerous specific details are set forth such as specific equipment, materials, and process parameters, etc., in order to provide a thorough understanding of the present invention. It will obvious, however, to one skilled in the art that the present invention may be practiced with these specific details. In other instances, well-known semiconductor equipment and processes have not been described in particular detail in order to avoid unnecessarily obscuring the present invention.

Figure 1A:
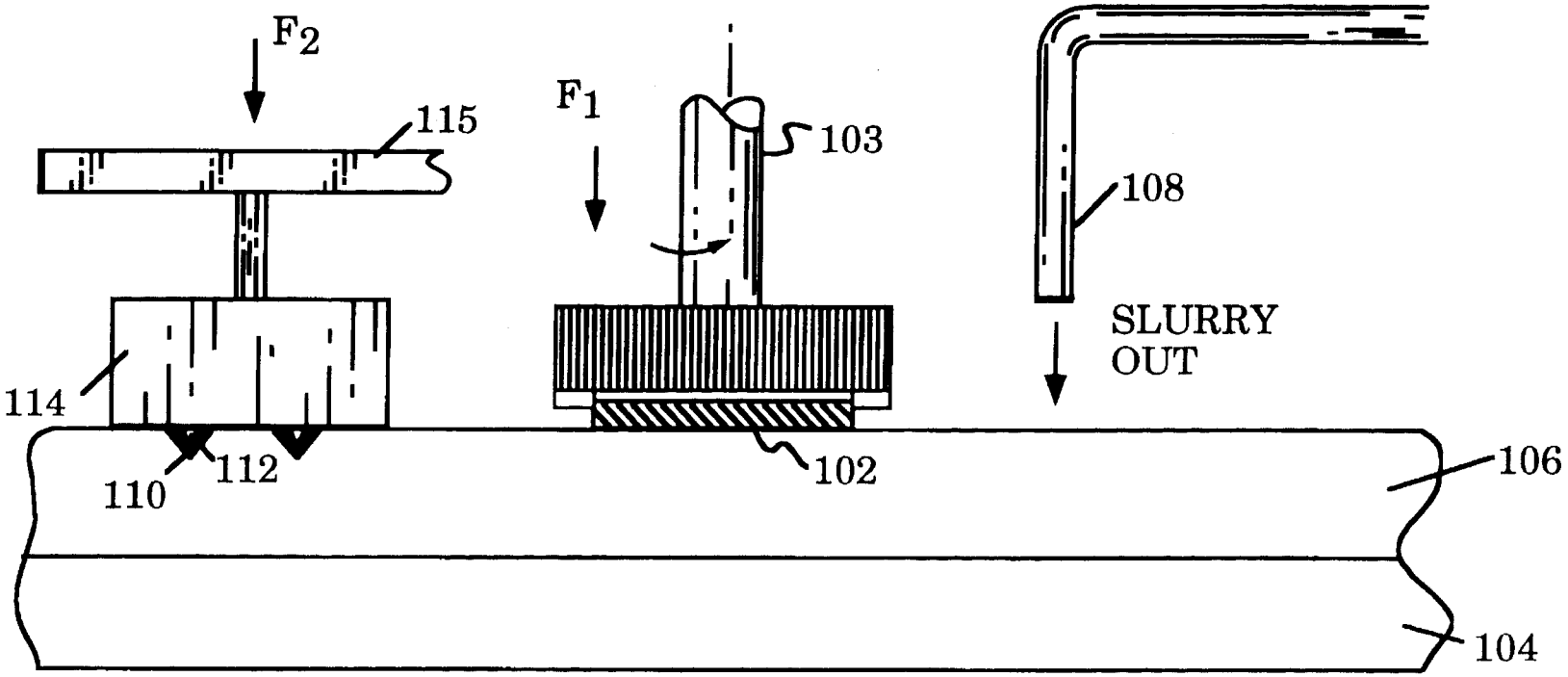
FIG. 1*a* is an illustration of a cross-sectional view of a polishing apparatus which includes an earlier polishing pad conditioning assembly.
Figure 1B:
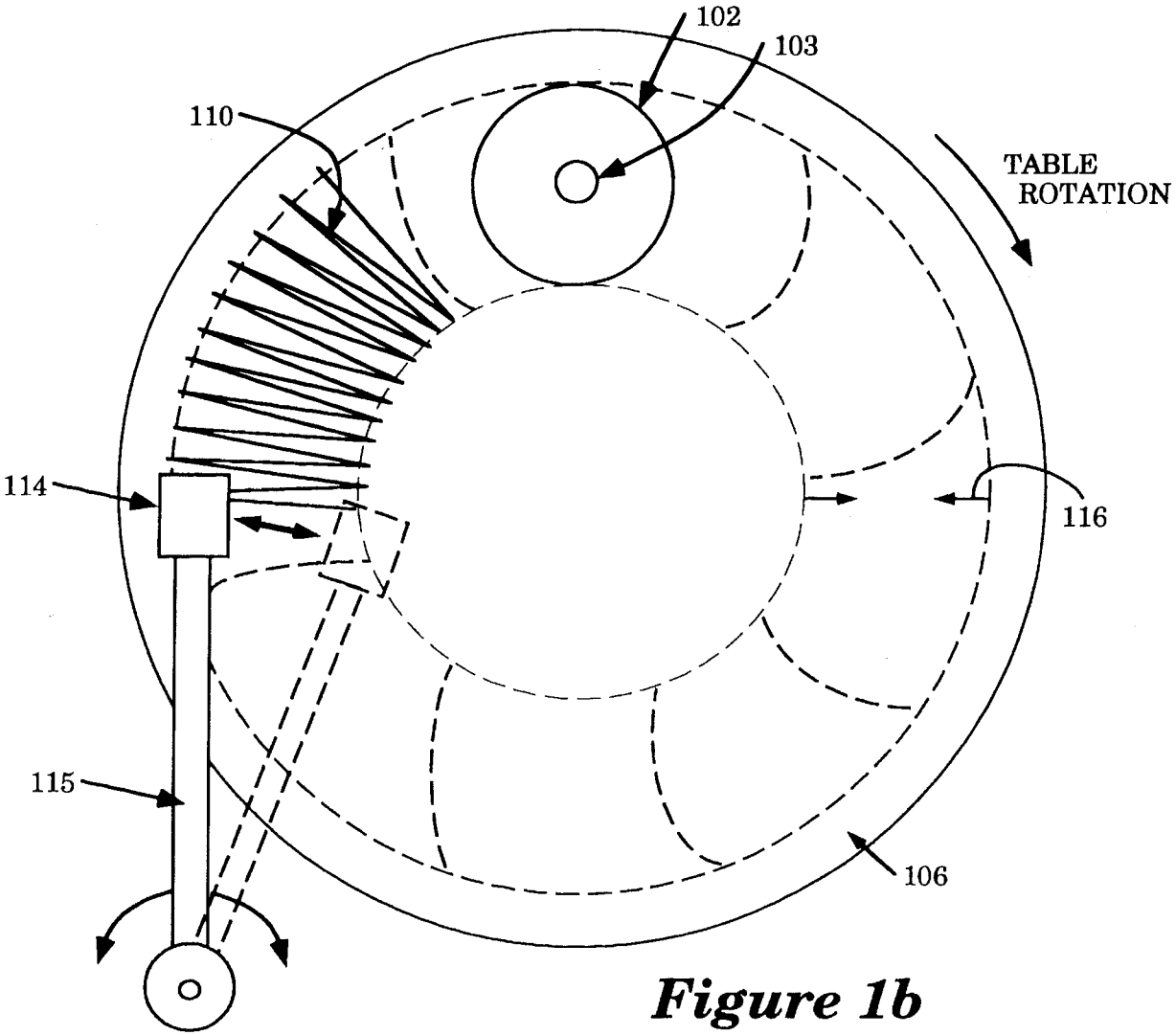
FIG. 1*b* is an illustration of an overhead view of the polishing apparatus shown in FIG. 1*a*.
Figure 2A:
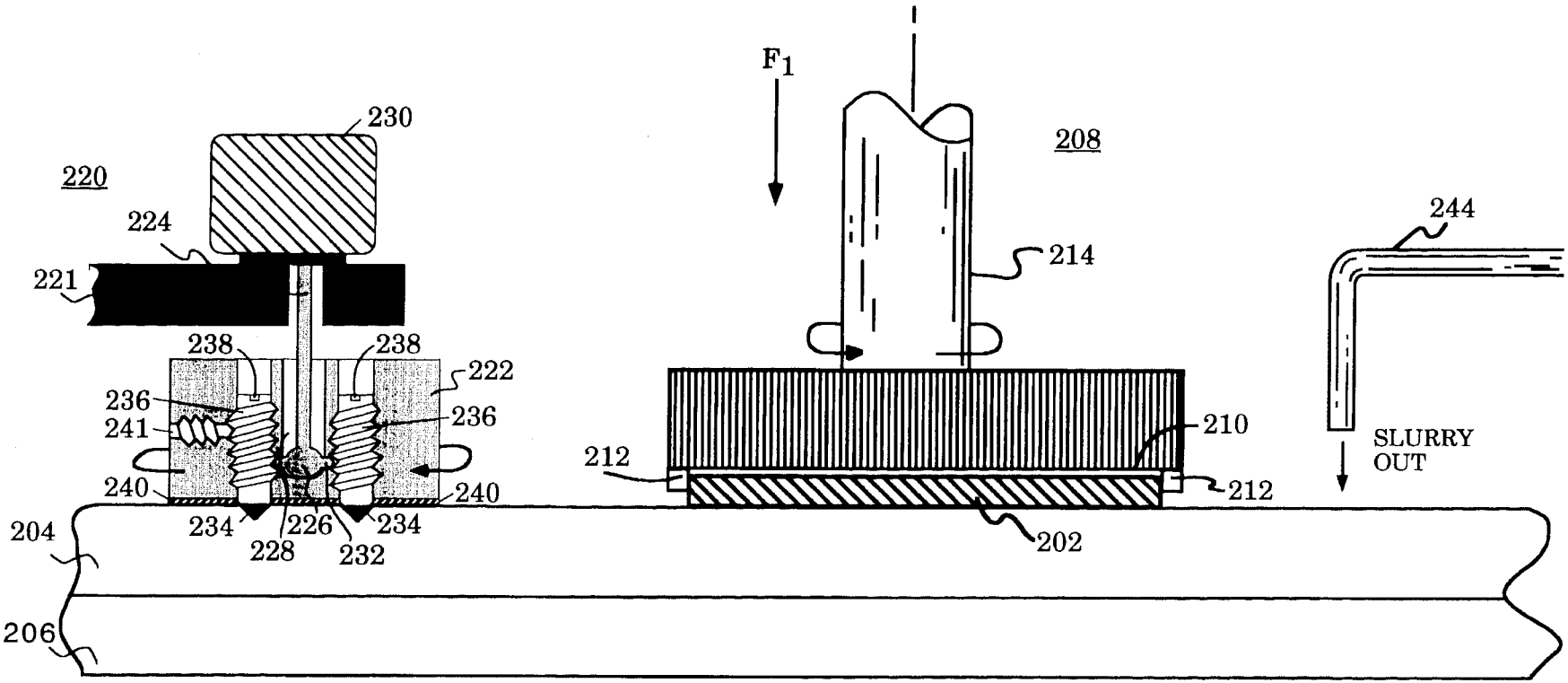
FIG. 2*a* is an illustration of a cross-sectional view of a polishing apparatus of the present invention which includes a novel pad conditioning assembly.

With reference to FIG. 2*a*, a side view of a polishing apparatus including a pad conditioning assembly of the present invention is illustrated. The polishing apparatus is used to planarize a thin film layer formed over a semiconductor substrate. The thin film is typically an interlayer dielectric (ILD) formed between two metallization layers of a semiconductor integrated circuit. The thin film, however, need not necessarily be an ILD, but can be any one of a number of thin films used in a semiconductor circuit manufacturing, such as but not limited to: metal layers, organic layers, and even the semiconductor material itself. In fact, the pad conditioning technique of the present invention can be generally applied to any polishing process which uses similar equipment where polishing pad smoothing causes the polishing rate to decline or to become unstable. For example, the present invention may be useful in the manufacturing of metal blocks, plastics and glass plates.

During planarization, a silicon substrate or wafer 202 is placed face down on the upper surface of a polishing pad 204 which is fixedly attached to the upper surface of table 206. In this manner, the thin film to be polished is placed in direct contact with the upper surface of polishing pad 204. According to the present invention, pad 204 comprises a relatively hard polyurethane or similar material capable of transporting abrasive particular matter such as silica particles. In the currently preferred embodiment of the present invention, an initially non-perforated pad manufactured by Rodel, Inc. known by the name "IC1000" is employed. It is to be appreciated that similar pads having similar characteristics may be used in accordance with the invented method and apparatus. Generally, a plurality of preformed circular grooves (not shown) are generated in polishing pad 204 prior to any polishing. Preformed grooves help facilitate the polishing process by providing a plurality of point contacts between the substrate and the polishing pad and by delivering slurry to the pad/substrate interface.

A carrier 208, also known as a "quill", or similar means, is used to apply a downward pressure F1 against the backside of substrate (or wafer) 202. The backside of substrate 202 is held in contact with the bottom carrier 208 by a vacuum or by simply wet surface tension. Preferably, an insert pad 210 cushions substrate 202 from carrier 208. An ordinary retaining ring 212 is employed to prevent substrate 202 from slipping laterally from beneath carrier 208 during polishing. The applied pressure F1 is typically on the order of four to nine pounds per square inch and is applied by means of shaft 214 attached to back side of carrier 208. The applied pressure F1 is used to facilitate the abrasive polishing of the upper surface of the thin film. Shaft 214 may also rotate to impart rotational movement to substrate 202. This greatly enhances the polishing process. It is to be appreciated that other carriers such the improved carriers described in co-pending U.S. patent application Ser. No. 08/103,918, filed Aug. 6, 1993 and assigned to the present assignee, may be used if desired.

The polishing apparatus of the present invention includes a novel pad conditioning assembly 220. Pad conditioning assembly 220 is used to generate a plurality of grooves into the top surface of polishing pad 204 during polishing. The grooves help to facilitate the polishing process by continually providing a plurality of point contacts between the substrate and polishing pad, as well as helping to channel slurry to the pad/substrate interface. Although polishing pad 204 is initially provided with a plurality of grooves, the effectiveness of these grooves reduces over time. It is, therefore, recommended to continually generate micro-grooves in polishing pad 204 during polishing. By continually generating grooves into polishing pad 204 during polishing, the present invention improves polish rate uniformity across a substrate and from substrate to substrate. The pad conditioning technique of the present invention makes the planarization process of the present invention extremely uniform, reliable, and ultra-large scale integrated circuit (ULSI) manufacturable.

A preferred embodiment of pad conditioning assembly 220 is shown in FIG. 2*a*. A stainless steel rotatable conditioning block 222 is coupled by a "ball and socket" joint to shaft 224. A ball 226 is rigidly connected to one end of shaft 224. Ball 226 fits securely inside of socket 228 formed in rotatable conditioning block 222. The "ball and socket" joint allows conditioning block 222 to move freely in the vertical direction during polishing so that the planar bottom surface of conditioning block 222 remains in uniform contact with polishing pad 204 even when undulations are present in pad 204. The end of drive shaft 224 opposite to ball 226 is coupled to a well-known variable speed electric drive motor 230, such as a Micro Mo Brushless DC - Servomotor (2444SBL1). Electric motor 230 is capable of rotating shaft 224 and conditioning block 222 at rates between 200–2000 rotations per minute. A drive pin 232 rigidly connected to the equator of ball 232 transfers the torque of shaft 224 to conditioning block 222. The combination of a "ball and socket" joint and a drive pin 232 allows conditioning block 222 to move freely with undulations in pad 204 while being rotated by drive motor 230.

Conditioning block 222 contains four stainless steel diamond-tipped 234 threaded shanks 236 which provide discreet points for generating grooves into polishing pad 204. The diamond tips 234 extend a distance of approximately 30–50 microns from the substantially planar bottom surface of conditioning block 222. Grade A or AA diamond tips 234 without flaws or major cracks, grounded into a cone having a 90° angle, can be attached to stainless steel threaded shanks 236. The threaded shanks 236 have Hex driver sockets 238 on the top surface so that the distance at which diamond tips 234 extend from conditioning block 222 can be easily varied. The threads on shanks 236 help to securely fasten shanks 236 to conditioning block 222. The stainless steel threaded shanks are approximately 0.5 inches in length and have a diameter of approximately ⅛ of an inch. It is to be appreciated that other means besides diamond tip threaded shanks 236 can be used to generate grooves into polishing pad 204. Cross locks of nylon tipped set screws 241 can be used to prevent diamond tipped shanks 236 from shifting adjustment during usage. Additionally, a wear resistant surface plate 240, of for example silicon-carbide, is preferably attached to the bottom surface of conditioning block 222. Wear resistant surface plate 240 prevents conditioning block 222 from becoming worn during polishing so that the bottom surface of conditioning block 222 remains substantially planar for long periods of time.

Figure 2B:
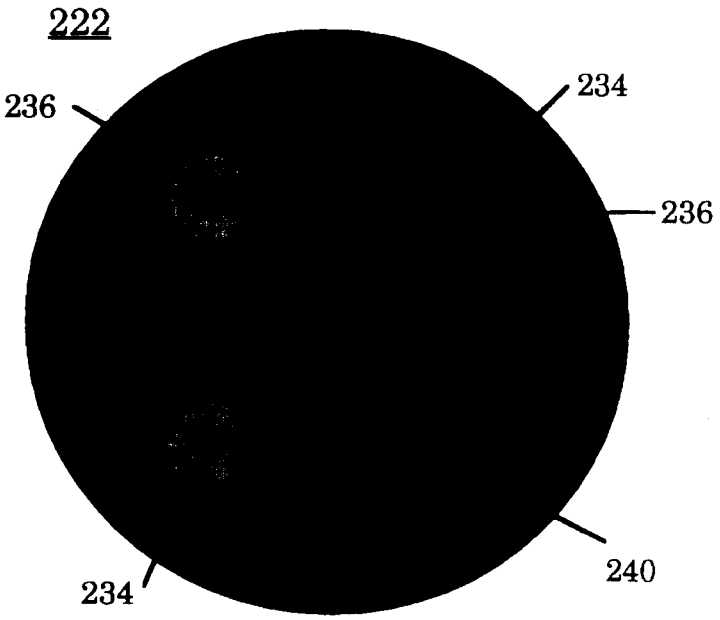
FIG. 2*b* is an illustration of a bottom view of a conditioning block of the pad conditioning assembly of the present invention.

FIG. 2*b* shows a bottom view of conditioning block 222. The four diamond tipped threaded shanks 236 in a preferred embodiment of the present invention are positioned at the indices of a square having between 0.25 to 1 inch sides. It is to be appreciated that alternative placements can be used, if desired. Conditioning block 222 in a preferred embodiment of the present invention is an approximately 0.50 to 2 inch diameter cylindrical stainless steel block. Use of a small diameter block allows conditioning block 222 to better track the contours of polishing pad 204. Additionally, with a small diameter block it is simpler to provide a substantially planar bottom surface.

Figure 2C:
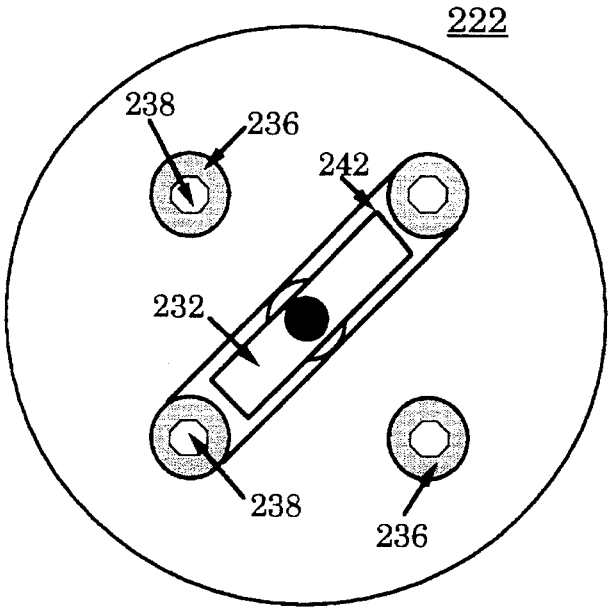
FIG. 2*c* is an illustration of a top view of a conditioning block used in the pad conditioning assembly of the present invention.

FIG. 2*c* shows a top view of conditioning block 222. Hex driver sockets 238 of threaded shanks 236 are readily accessible to allow for easy length adjustment and replacement of diamond tipped threaded shanks 236. Conditioning block 222 has a drive slot 242 in which drive pin 232 is situated. In order to rotate conditioning block 222, torque is delivered by drive pin 232 to the sidewalls of drive slot 242.

Figure 2D:
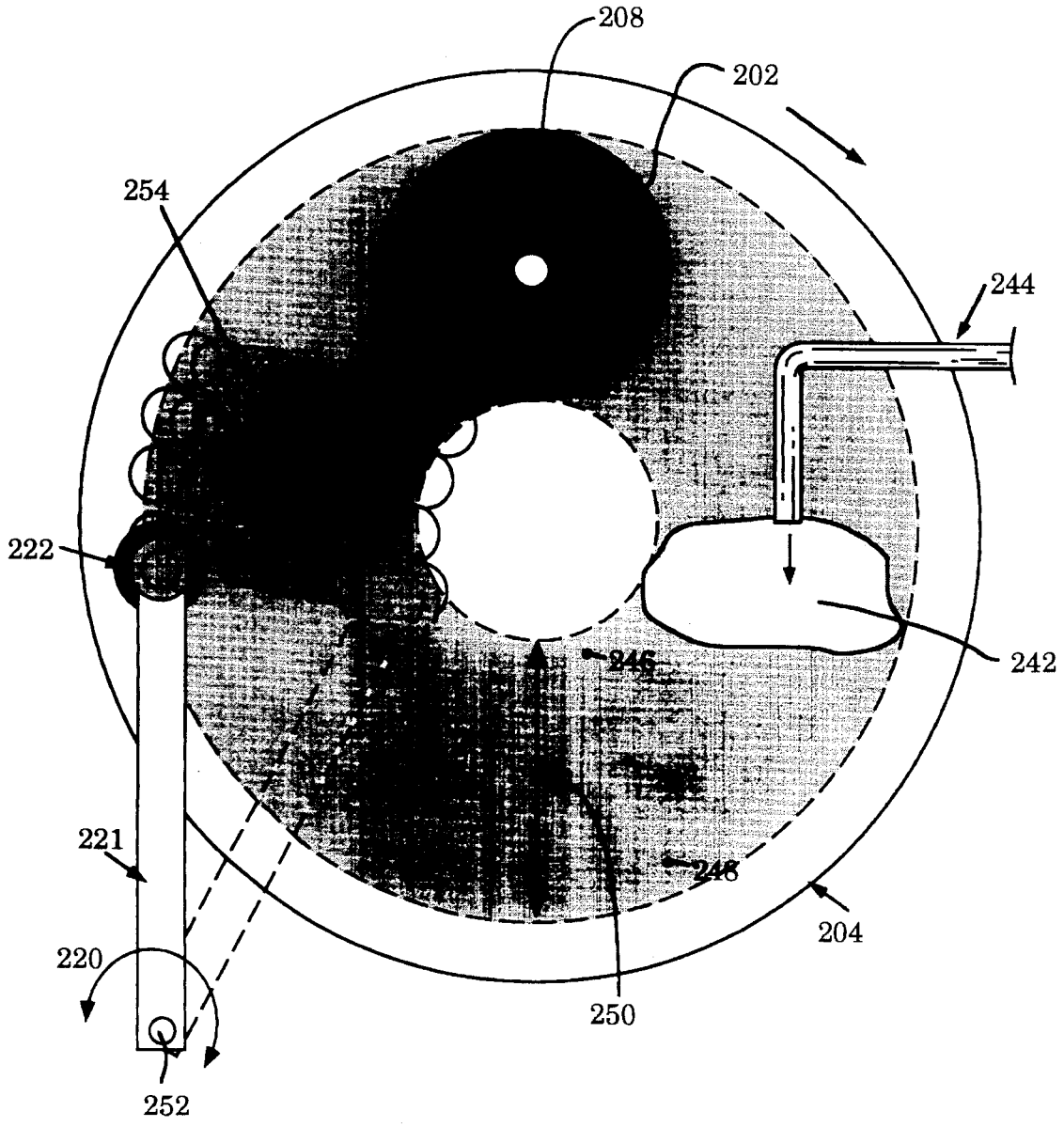
FIG. 2*d* is an illustration of an overhead view of the polishing apparatus shown in FIG. 2*a*.

In reference to FIG. 2*d*, during polishing a substrate (or wafer) 202 is placed face down on polishing pad 204 so that the material to be polished on substrate 202 is placed in direct contact with the upper surface of polishing pad 204. In a preferred method of the present invention substrate 202 is pressed face down against polishing pad 204 at a pressure of between four and nine pounds per square inch by carrier 208. Additionally, during polishing carrier 208 is rotated at a rate of between 20–90 rpms to help enhance the polishing process. In the currently preferred embodiment of the present invention, table 206 and polishing pad 204 rotate at a rate of approximately 10–70 rpms. As table 206 and polishing pad 204 are rotated, a silica-based solution 242 (frequently referred to as "slurry") is deposited or pumped through a pipe 244 onto the upper surface of polishing pad 204. Currently a slurry known as SC3O1O, which is manufactured by Cabot, Inc. is preferably used for polishing $SiO_2$ insulating layers. During the polishing process, slurry particles become embedded in the upper surface of polishing pad 204. The relative rotational movement of carrier 208 and table 206 facilitate the polishing of the thin film. Abrasive polishing continues in this manner until a highly planar upper surface is produced and the desired thickness reached.

According to a preferred embodiment of the present invention, polishing pad 204 is continually conditioned by pad conditioning assembly 220 during polishing. According to the present invention, conditioning block 222 is rotated while it is moved back and forth between an inner radius 246 and an outer radius 248 of polishing pad 204, wherein the conditioned area includes at least polish track 250 created by the substrate 202 being polished. Conditioning block 222 is moved or swept back and forth across polishing track 250 at a rate of between one to fifteen cycles per minute. Conditioning block 222 can be moved across polishing pad 204 by coupling the end of conditioning arm 221 opposite conditioning block 222 to a variable speed oscillating motor located at pivot point 252. A variable speed motor allows conditioning block 222 to be swept across different radii of polishing pad 204 at different rates. It is to be appreciated that other means, such as a reciprocating mechanism, can be used to move conditioning block 222 between the inner and outer radii of polishing pad 204. It is important to note that the rotation rate of polishing pad 204 and the sweep rate of conditioning block 222 should not be the same, or multiples thereof, so that all portions of polishing pad 204 receive some conditioning.

As conditioning block 222 is rotated and moved back and forth across polishing pad 204, the diamond tipped threaded shanks 234 condition polishing pad 204 by forming grooves 254 in polishing pad 204. Grooves 254, in a preferred embodiment of the present invention, are formed at an approximate depth of between 30–50 microns. The depth of grooves 254 is set by the distance at which diamond tipped threaded shanks 234 extend from conditioning block 222 (or wear resistant plate 240 if used). The weight of conditioning assembly 220 provides a downward force (approximately 16 ounces) sufficient to embed diamond tips 234 into the top surface of the polishing pad 204. The substantially planar bottom surface of conditioning block 222 acts as a mechanical stop to ensure that diamond tips 234 are embedded into polishing pad 204 to the desired depth.

It is to be appreciated that by using a conditioning block which rotates in the present invention, the surface of wear plate 240 maintains substantial planarity during its lifetime. The earlier style non-rotating block typically developed a wavy surface after several hundred hours of use, after which time it was advisable to relap and smooth the surface. At the same lifetime, a rotating conditioning block shows an essentially flat surface (within 0.002 inches).

In a preferred method of the present invention, conditioning assembly 220 conditions the middle radii 247 of polishing pad 204 more than the inner radii 246 and outer radii 248 of polishing pad 204. In order to accomplish this according to a preferred method of the present invention, conditioning block 222 is swept back and forth across polish track 250 at a constant rate (constant sweep rate) and is rotated fastest while at the middle radii 247 of the polishing pad 204 and slowest while at the outer 248 and inner 246 radii of polishing pad 204. In this way the middle radii 247 of polishing track 250 receives more conditioning than the outer radii 248 and inner radii 246 of polishing pad 204. It has been found that the circular shape of silicon wafers causes polishing pad 204 to become worn across the polishing track to a degree proportional to the ratio of the wafer area (at that radius) to the annular polishes pad area (at the same radius). That is, the circular shape of wafers cause polishing pad 204 to become more worn at the center of polishing track 250 than at the outer or inner edges of polishing track 250. The result is polishing pad 204 polishes the outer edge of substrate 202 at a higher polishing rate (where the pad is less worn) than it polishes the center of substrate 202 (where pad is more worn). The present invention, therefore, conditions polishing pad 204 more at the middle radii of the polishing track 250 because the polishing pad is more smooth or worn at the middle radii. By conditioning the middle radii of polishing track 250 more than the outer and inner radii, polishing pad 204 maintains a uniform roughness across its surface. In this way the polishing rate of the present invention is uniform across the surface of a substrate and from substrate to substrate.

In another preferred method of nonuniformly conditioning polishing pad 204 according to the present invention, conditioning block 222 is rotated at a constant rate (constant rotation rate) while it is swept between the inner and outer radii at different rates (i.e., variable sweep rate). In this method it is preferred to move conditioning block 222 faster at the outer and inner radii of the polishing pad than at the middle radii so that the middle radii receives the most conditioning. It is to be appreciated that with the present invention one can vary the rotation rate, the sweep rate, or both, of conditioning block 222 in order to obtain a specific pad conditioning profile which is tailored for a specific polishing environment. These features can be used to tailor the removal rates at different areas of the polishing pad. These features can be used, for example, to control the removal rate at the center of a substrate differently from that at the edges of the substrate which yields an effective means of controlling center to edge nonuniformity (or curvature correction). The method and apparatus of the present invention provide a flexible and reliable pad conditioning process.

Thus, an apparatus and method for planarizing a thin film formed over a semiconductor substrate has been described. The method and apparatus utilize a novel pad conditioning assembly for continually generating grooves into a polishing pad surface while substrates are being polished. The novel pad conditioning assembly of the present invention can condition a polishing pad in a reliable nonuniform manner without reducing the polish rate.

I claim:

1. A pad conditioning assembly for generating a plurality of grooves in a polishing pad used to polish thin films formed on a semiconductor substrate, said pad conditioning assembly comprising:

a rotatable conditioning block having a top surface and a substantially planar bottom surface; said rotatable conditioning block capable of sweeping back and forth between an inner radius of said polishing pad and an outer radius of said polishing pad while said rotatable conditioning block rotates about an axis substantially perpendicular to said polishing pad and said substantially planar bottom surface having a plurality of discreet points extending from said substantially planar bottom surface capable of generating said plurality of grooves.

2. The assembly of claim 1 wherein said discreet points are diamond tipped threaded shanks.

3. The assembly of claim 2 wherein there are four diamond tipped threaded shanks extending from said substantially planar bottom surface of said conditioning block and wherein said diamond-tipped threaded shanks are disposed at the indices of a square.

4. The assembly of claim 1 further comprising a conditioning arm having one end coupled to said rotatable conditioning block and the other end coupled to means for pivoting said conditioning arm about a pivot point such that said rotatable conditioning block sweeps back and forth between said outer radius of said polishing pad and said inner radius of said polishing pad.

5. The apparatus of claim 4 further comprising:

a drive shaft having one end coupled to a ball, said ball engaging a socket formed in said rotatable conditioning block to form a flexible ball and socket joint, the end of said drive shaft opposite to said ball coupled to said conditioning arm.

6. The apparatus of claim 5 further comprising:

a variable speed drive motor attached to said conditioning arm and coupled to the end of said drive shaft, opposite to said ball, and said variable speed drive motor for rotating at varying rates said drive shaft and said rotatable conditioning block.

7. The apparatus of claim 4 wherein said means for pivoting said conditioning arm is a variable speed oscillating motor.

8. The apparatus of claim 1 further comprising:

reciprocating means coupled to said conditioning block, said reciprocating means for linearly moving said conditioning block between said outer radius of said polishing pad and said inner radius of said polishing pad.

9. The apparatus of claim 1 further comprising a wear-resistant surface plate attached to the substantially planar bottom surface of said conditioning block such that said discreet points extend beyond said wear-resistant surface plate.

10. The apparatus of claim 1 wherein said rotatable conditioning block has a diameter of between 0.5–2.0 inches.

11. A method of polishing a thin film formed over a semiconductor substrate comprising the steps of:

a) rotating a polishing pad;

b) placing a substrate on said rotating polishing pad such that said thin film to be polished is placed in direct contact with said polishing pad; and c) conditioning said polishing pad by forming a plurality of grooves into said polishing pad, said grooves formed by rotating a conditioning block about an axis substantially perpendicular to said polishing pad, said rotatable conditioning blocks having a substantially planar bottom surface with a plurality of groove-generating discreet points extending from said substantially planar bottom surface while moving said rotating conditioning block between an outer radius of said polishing pad and an inner radius of said polishing pad.

12. The method of claim 11 wherein said conditioning block is rotated at a rate of between 200–2000 rotations per minute.

13. The method of claim 11 wherein said conditioning block sweeps between said outer radius of said polishing pad and said inner radius of said polishing pad at a rate of between one cycle to 15 cycles per minute.

14. The method of claim 11 wherein said conditioning block is moved between said outer radius of said polishing pad and said inner radius of said polishing pad at a variable rate.

15. The method of claim 14 wherein said conditioning block sweeps faster at said inner radius and said outer radius than at a center radius of said polishing pad, said center radius between said inner radius and said outer radius.

16. The method of claim 11 wherein said conditioning block rotates at a variable rate while moving between said inner radius of said polishing pad and said outer radius of said polishing pad.

17. The method of claim 16 wherein said conditioning block rotates faster when said conditioning block is at a center radius of said polishing pad than when said conditioning block is at said inner radius or said outer radius of said polishing pad, said center radius between said inner radius and said outer radius of said polishing pad.

18. The method of claim 11 wherein said conditioning block rotates at a variable rate while moving between said inner radius and said outer radius of said polishing pad and wherein said conditioning block moves between said inner radius and said outer radius of said polishing pad at a variable rate.

19. The method of claim 11 wherein said conditioning block is rotated and swept across said polishing pad in such a manner so as to modulate the center to edge removal rates of said thin film on said substrate.

* * * * *